United States Patent [19]

Earley

[11] Patent Number: 4,545,743

[45] Date of Patent: Oct. 8, 1985

[54] OIL STIRRER FOR REFRIGERATION COMPRESSOR

[75] Inventor: Robert W. Earley, Worthington, Ohio

[73] Assignee: White Consolidated Industries, Inc., Cleveland, Ohio

[21] Appl. No.: 136,679

[22] Filed: Apr. 2, 1980

[51] Int. Cl.[4] ..... F04B 17/00; F04B 35/00

[52] U.S. Cl. ..... 417/372; 417/902

[58] Field of Search ..... 417/902, 372

[56] References Cited

U.S. PATENT DOCUMENTS

| | | | |
|---|---|---|---|
| 2,228,364 | 1/1941 | Philipp | 417/372 X |
| 2,264,847 | 12/1941 | Johnson | 417/372 X |
| 2,930,522 | 3/1960 | Reichard | 417/372 X |
| 2,996,240 | 8/1961 | Stöcklein et al. | 417/372 |
| 3,147,914 | 9/1964 | Hatten et al. . | |
| 3,285,504 | 11/1966 | Smith | 417/902 X |
| 3,441,202 | 4/1969 | Valbjorn et al. | 417/902 X |
| 3,480,205 | 11/1969 | Hatten . | |
| 3,614,384 | 10/1971 | Heitchue | 417/312 |
| 4,127,994 | 12/1978 | Niven | 417/372 X |

FOREIGN PATENT DOCUMENTS

| | | | |
|---|---|---|---|
| 1026335 | 3/1958 | Fed. Rep. of Germany | 417/902 |

*Primary Examiner*—Richard E. Gluck

*Attorney, Agent, or Firm*—Pearne, Gordon, Sessions, McCoy, Granger 6 Tilberry

[57] ABSTRACT

A refrigeration compressor assembly includes a motor compressor mounted within a hermetically sealed shell with a sump area at the bottom containing a lubricating oil. An oil stirrer is secured to the crankshaft below the motor components and includes a hub secured to the crankshaft and a conical, smooth, imperforate skirt extending outwardly and downwardly below the oil surface. The oil stirrer is formed of a plastic insulating material which does not permit the formation of eddy currents within the oil stirrer from the motor flux leakage and whose surface is not wetted by the lubricating oil.

14 Claims, 3 Drawing Figures

OIL STIRRER FOR REFRIGERATION COMPRESSOR

BACKGROUND OF THE INVENTION

This invention relates generally to hermetically sealed refrigeration compressors and, more particularly, to oil-stirring devices for use in such compressors.

The hermetically sealed refrigeration compressor is almost universally used in household refrigerators and freezers, as well as room air conditioners and many other machines using a refrigeration system, such as ice-making machines, vending machines, and the like. In these compressors, there is an oil reservoir in the bottom portion of the sealed container, while the upper space is filled with the refrigerant gas so that the entire internal system, in combination with the evaporator and condenser coil assemblies, is completely sealed from the outside air. Once the system is charged with a refrigerant, it continues to operate as a sealed unit and the oil in the reservoir at the bottom of the container must last for a long period of time to lubricate the moving parts of the compressor without interfering with the rest of the refrigerant-containing system.

One of the problems with refrigeration compressors, particularly when they are used in household refrigerators and freezers, is that of the noise produced by the mechanism. While the noise has many sources within the compressors, it has been recognized that noise can be reduced by producing a controlled amount of foaming of the lubricating oil. While the earliest designs, such as those disclosed in U.S. Pat. Nos. 3,066,857 and 3,155,312, both assigned to the assignee of the present invention, use the approach of actually bubbling refrigerant through the lubricating oil, it was subsequently found that a simpler approach was to put a stirring device on the end of the motor crankshaft and have it immersed a short distance below the upper surface of the lubricating oil. While such stirring in itself would assist the foaming, it is also recognized that much of the foaming action results from the fact that a certain amount of the gaseous refrigerant dissolves in the lubricating oil and the agitating action aids in causing the gaseous refrigerant to effervesce and form small bubbles. This results in the formation of an oil foam on the upper surface of the oil and around the interior of the compressor shell.

Many devices have been proposed for producing this stirring action, including those shown in U.S. Pat. Nos. 3,147,914; 3,480,205 and 3,614,384. However, such devices tended to be rather delicate and easily damaged during the assembly of the compressor and if distorted in any way would produce an excessive amount of agitation, which could not only interfere with proper lubrication of the compressor but could also result in an increase in energy consumption because of the amount of work put into the agitating action.

An improved oil stirring device is shown in U.S. Pat. No. 4,127,994, also assigned to the assignee of the present invention, which utilizes a conical sheet metal member with perforations therein which is pressed into place on the end of the crankshaft and projects downwardly a distance into the oil. With this device, there was an improved reduction in noise, although the device tended to be expensive to manufacture and could be bent and distorted out of the proper conical shape during normal handling and during assembly of the compressor.

SUMMARY OF THE INVENTION

The present invention provides an improved oil stirrer for a hermetically sealed refrigeration compressor which is rugged in construction and relatively low in cost while permitting increased efficiency of the compressor in terms of electric power consumption. The oil stirrer is in the shape of a cone having relatively thick walls and parallel inner and outer sides which is attached to the lower end of the refrigeration crankshaft so the bottom end of the cone extends downwardly below the upper surface of the lubricating oil. Although the surface of the cone is smooth and imperforate, it is formed of a nonmetallic material which is not wetted by the lubricating oil and this fact, in common with a slight degree of surface roughness, produces the desired amount of foaming of the oil without excessive agitation which tends to cause energy loss. Furthermore, because the oil stirrer is nonmetallic, it does not generate any eddy currents from the magnetic fields produced by the stator windings of the electric motor, and therefore produces improved efficiency as compared to a metallic member.

DESCRIPTION OF THE PREFERRED EMBODIMENT

Figure 1:
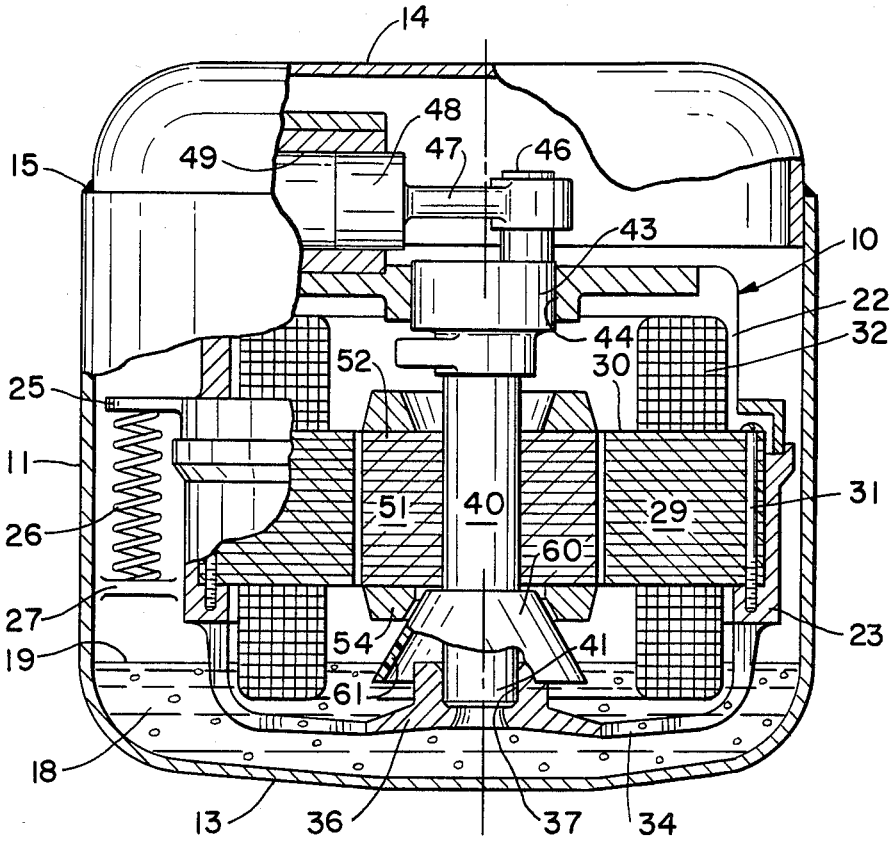
FIG. 1 is an elevational view of a hermetically sealed refrigeration compressor with portions cut away, incorporating an oil stirrer constructed in accordance with the preferred embodiment of the present invention.
Figure 2:
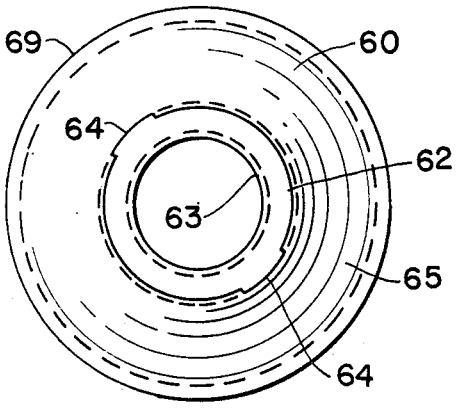
FIG. 2 is a plan view of the oil stirrer illustrated in FIG. 1.
Figure 3:
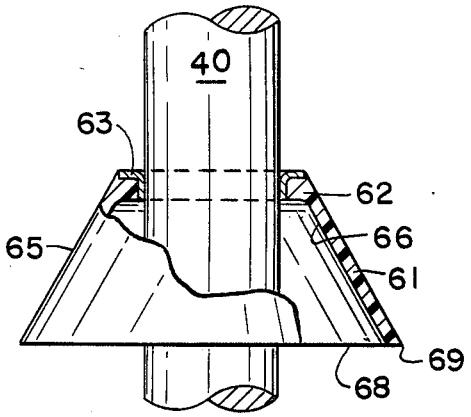
FIG. 3 is an elevational view, partly broken away, of the oil stirrer of the present invention.

Referring now to the drawings in greater detail, FIG. 1 discloses a hermetically sealed refrigeration compressor 10 which is mounted within a metal shell 11. The shell 11 is formed from lower and upper sections 13 and 14 which are secured together along a welded seam 15. In operation, the compressor is mounted on a suitable frame containing the other refrigeration system components in an upright position, and a predetermined amount of lubricating oil 18 is located in the bottom portion of the lower shell section 13 to define an upper surface or oil lever 19, while the space within the shell 11 above the level 19 is filled with the refrigerant gas.

The compressor mechanism within the shell 11 generally comprises an upper frame 22 secured together with a lower frame 23, although it is recognized in some constructions only a single frame member may be used. The frame is resiliently mounted within the shell 11 so that the vibrational modes of the motor compressor are substantially isolated from the shell 11, and such mounting may be accomplished by providing projecting lugs 25 on the upper frame member 11 which engage compression springs 26 supported at their lower ends by suitable support lugs 27 on the inside of the lower shell 13. Of course, other resilient mounting means may be used in the manner well-known in the art and they do not form any portion of the present invention.

The electric motor portion of the compressor assembly 10 includes a stator 29 including a laminated stator core 30 which is secured within the lower frame 23 by suitable means, such as screws 31, and carries windings 32 which project both upwardly and downwardly beyond the core 30. At its lower end, the lower frame 23 includes a spider frame 34 extending downwardly and inwardly from the stator core 30 to support a bearing boss 36 at its center. The bearing boss 36 is formed with a radial and thrust bearing 37 which receives the lower end of a vertically extending crankshaft 40 to support the vertical weight of the crankshaft and rotor and provide a radial guide at the lower end of the stator 29. The crankshaft 40 is formed with a lower bearing journal 41 adapted to fit within the bearing 37 and extends upwardly through the upper frame 22 where it carries an upper bearing journal 43 which makes bearing engagement with a bearing portion 44 of the upper frame 22. Above the bearing journal 43, there is a vertically extending offset crank pin 46 to which is connected a suitable connecting rod 47 whose other end is connected to a piston 48 adapted to reciprocate within a horizontally extending pumping cylinder 49. Between the two bearing journals 41 and 43, the crankshaft 40 carries a rotor 51 in proper alignment with the stator core 30 and, as shown, the rotor 51 includes laminations 52 and the conducting portions of rotor 51 may include downwardly extending portions 54 which may include suitable fins (not shown) for cooling purposes, as well as counterweights for maintaining balance of the rotating elements.

It will be understood that the foregoing description of a hermetically sealed refrigeration compressor is by way of example to set forth the background and mode of operation of the present invention, and not by means of limitation to any specific structure.

Directly below the rotor 51, the oil stirrer 60 of this invention is located on the crankshaft 40 beneath the lower portion 54 of the rotor. The oil stirrer is in the form of a conical member formed of a suitable nonmetallic plastic material, such as a glass fiber-filled polyester thermoplastic resin. The stirrer at its upper end has a hub portion 62 surrounding the crankshaft 40 and containing a metallic insert 63. The insert 63 is formed from sheet metal and is molded in place in the stirrer and held there by suitable projecting lugs 64 which are embedded in the material of the hub 62 to prevent relative rotation between the stirrer and the insert. This insert is made an interference fit with the crankshaft 40 so that the stirrer can be pressed on the end of the crankshaft and will stay in place in spite of changes of temperature as long as the compressor is operable.

As stated, the stirrer is in the form of a cone having a skirt or side walls 61 that extend outwardly and downwardly at an angle of approximately 30 degrees with respect to the axis of the crankshaft 40. Both the outer surface 65 and the inner surface 66 are substantially parallel to each other and allow a wall thickness of 2 to 2.5 mm. to provide a high degree of rigidity. At its lower end, the sidewalls or skirt 61 at the stirrer 60 terminate in an annular bottom surface 68 extending perpendicular to the axis of the crankshaft 40 and this bottom surface 68 intersects the outer surface 65 in a relatively sharp, annular, outer edge 69 having a diameter of about 65 mm.

It is important that this cone be symmetrical with respect to the axis of rotation of the crankshaft 40 so that during rotation it has no substantial run-out which would cause excessive agitation of the oil. In operation, the skirt of the stirrer extends approximately one-third of its height below the upper surface 19 of the lubricating oil and the material and its surface finish are such that the outer surface is not wetted by the oil. Because of the glass fiber filler in the plastic, the surface finish of the stirrer is not glossy but, rather, is slightly roughened, depending upon the amount of filler in the plastic. When the compressor is running at its normal rotational speed of 3200 to 3500 rpm, no turbulence or agitation is produced because of any unsymmetrical shape of the stirrer. However, there are frictional forces provided because of the relative movement between the stirrer and the lubricating oil that tend to force the boundary layer of the oil next to the outer surface 65 to move downwardly and outwardly until it reaches the outer edge 69, where the oil then flows radially outwardly to result in a stirring action of the oil that causes the dissolved refrigerant to effervesce and produce a controlled amount of foaming of the oil. Because the surface of the stirrer is not wetted by the oil, there generally is a laminar flow of the oil along the surface of the stirrer without significant turbulence, which would produce excessive foaming, and hence energy losses in the motor. Since increasing the amount of glass fiber filler in the stirrer increases the surface roughness, and hence the amount of friction between the unwetted surface and the oil, the amount of stirring and foaming can be varied to meet the particular requirements of a given compressor.

It should be further noted from FIG. 1 that the oil stirrer is immediately adjacent the rotor 51 and, therefore, does pass through the stray fields from the stator windings 32. If the oil stirrer were of a conductive metallic material, this effect would produce certain eddy currents within the stirrer which would cause heating and energy losses. However, because the stirrer is made of a nonmetallic material that is not conductive, there are no significant eddy current losses as compared to operation of the same unit without the stirrer in place.

Although the preferred embodiment of this invention has been shown and described, it is to be understood that various modifications and rearrangements may be resorted to without departing from the scope of the invention as defined by the claims.

What is claimed is:

1. A refrigeration compressor comprising a rigid outer shell, a motor compressor mounted within said shell and having a crankshaft mounted for rotation about a vertical axis, a body of lubricating oil within said shell below said motor compressor and having an upper surface extending in a plane perpendicular to said vertical axis, and an oil stirrer secured to said crankshaft to rotate therewith, said oil stirrer having a hub portion secured to said crankshaft and a rigid conical skirt extending outwardly and downwardly to terminate in an annular edge below said upper surface of said oil, said skirt being concentric with said vertical axis and having a smooth and imperforate wall, said skirt being formed of a non-metallic rigid plastic material whose surface is not wetted by said oil.

2. A refrigeration compressor as set forth in claim 1, wherein said skirt wall has parallel inner and outer surfaces.

3. A refrigeration compressor as set forth in claim 2, wherein said skirt wall terminates in an annular end surface lying in a plane perpendicular to said vertical axis.

4. A refrigeration compressor as set forth in claim 3, wherein said annular end surface and said outer surface intersect in a sharp annular edge.

5. A refrigeration compressor as set forth in claim 1, wherein said material is a glass fiber filled thermoplastic resin.

6. A refrigeration compressor as set forth in claim 5, wherein said hub portion includes an annular metal insert having an interference fit with said crankshaft.

7. A refrigeration compressor comprising a rigid outer shell, a motor compressor mounted within said shell and having a crankshaft mounted for rotation about a vertical axis, a body of lubricating oil within said shell below said motor compressor and having an upper surface extending in a plane perpendicular to said vertical axis, said motor compressor having a stator mounted above said body of lubricating oil and a rotor fixed on said crankshaft, and an oil stirrer secured to said crankshaft below said rotor to rotate therewith, said oil stirrer having a hub portion secured to said crankshaft and a rigid conical skirt extending outwardly and downwardly to terminate in an annular edge below said upper surface of said oil, said skirt being concentric with said vertical axis, said skirt being formed of a non-metallic rigid plastic insulating material whereby eddy currents in said skirt from flux leakage from said stator are minimized.

8. A refrigeration compressor as set forth in claim 7, wherein said skirt has a smooth and imperforate wall.

9. A refrigeration compressor as set forth in claim 8, wherein said insulating material has a surface which is not wetted by said oil.

10. A refrigeration compressor as set forth in claim 9, wherein said skirt wall has parallel inner and outer surfaces.

11. A refrigeration compressor as set forth in claim 10, wherein said skirt wall terminates in an annular end surface lying in a plane perpendicular to said vertical axis.

12. A refrigeration compressor as set forth in claim 11, wherein said annular end surface and said outer surface intersect in a sharp annular edge.

13. A refrigeration compressor as set forth in claim 9, wherein said insulating material is a glass fiber filled polyester resin.

14. A refrigeration compressor as set forth in claim 13, wherein said hub portion includes an annular metal insert embedded in said polyester resin and contacting said crankshaft with an interference fit to prevent relative movement between said oil stirrer and said crankshaft.

* * * * *